US010508498B2

(12) United States Patent
Cooper et al.

(10) Patent No.: US 10,508,498 B2
(45) **Date of Patent: *Dec. 17, 2019**

(54) HAMMER REAMER FOR EXPANDING A PILOT BORE

(71) Applicant: HARD ROCK HORIZONTAL DIRECTIONAL DRILLING PRODUCTS, INC., Winder, GA (US)

(72) Inventors: Cary Cooper, Winder, GA (US); Travis Parr, Winder, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/973,862

(22) Filed: May 8, 2018

(65) Prior Publication Data

US 2018/0266179 A1 Sep. 20, 2018

Related U.S. Application Data

(63) Continuation of application No. 15/231,727, filed on Aug. 8, 2016, now Pat. No. 9,995,084.

(60) Provisional application No. 62/202,205, filed on Aug. 7, 2015.

(51) Int. Cl.

| | |
|---|---|
| ***E21B 1/00*** | (2006.01) |
| ***E21B 10/28*** | (2006.01) |
| ***E21B 7/04*** | (2006.01) |
| ***E21B 7/28*** | (2006.01) |

(52) U.S. Cl.

CPC ..... *E21B 7/28* (2013.01); *E21B 1/00* (2013.01); *E21B 7/046* (2013.01); *E21B 10/28* (2013.01)

(58) Field of Classification Search

CPC ... E21B 7/28; E21B 7/046; E21B 1/00; E21B 4/14; E21B 10/28

See application file for complete search history.

(56) References Cited

U.S. PATENT DOCUMENTS 9,995,084 B1 * 6/2018 Cooper ..... E21B 1/00

* cited by examiner

*Primary Examiner* — Giovanna C Wright
*Assistant Examiner* — Yanick A Akaragwe
(74) *Attorney, Agent, or Firm* — Smith Tempel Blaha LLC; Matthew T. Hoots

(57) ABSTRACT

Disclosed is a hammer reamer comprising cutting wheels, a product-pulling feature, and a hammer component operable to deliver a percussive cycle of an internal piston component. Notably, an internal impact surface within the head of the hammer reamer is positioned relative to the piston component in the hammer consistent with a "sweet spot" position of a drill bit used in a pilot boring configuration. Unlike a slidably engaged drill bit, however, the internal impact surface in the hammer reamer is fixed in place so that the impact surface remains in the "sweet spot" of the piston stroke range. In this way, even though the hammer reamer is being pulled back through a bore while the drill string is being retracted, the hammer component may continue to deliver percussive blows to the hammer reamer head to introduce a vibratory force that contributes to the efficiency of the reaming process.

11 Claims, 6 Drawing Sheets

HAMMER REAMER FOR EXPANDING A PILOT BORE

BACKGROUND

The present disclosure relates to horizontal directional drilling ("HDD") and, more particularly, to an improved reamer device useful for expanding and conditioning a previously drilled pilot bore.

Horizontal directional drilling ("HDD"), also termed "slant drilling," is the practice of drilling non-vertical bores. A common application for HDD is for the installation of utility products such as underground wiring, small bore piping, cable bundles, and the like. The HDD process typically begins with drilling a pilot bore along a desired underground path. Next, the pilot hole is enlarged to a desired diameter and its walls conditioned by passing a larger cutting tool, sometimes termed a "reamer" or "back reamer," back through the pilot hole. Finally, the product is installed in the enlarged hole by way of being pulled behind the reamer as the drill string is retracted from the reamed bore.

As one of ordinary skill in the art would recognize, when drilling a pilot bore the drill string is pushing forward, thereby facilitating a percussion cycle with a hammer component and a slidably engaged drill bit on the leading end. The hammer in an HDD drill string of this sort is not able to "run on cushion," meaning that the reciprocation of the hammer will cease upon retraction of the drill string due to a resulting "open blow" alignment of internal air passages. Moreover, when the drill string is retracted, the slidably engaged drill bit is dragged along behind in a fully extended position that is out of reach of the hammer (the fully extended position of the drill bit correlates with the "open blow" alignment of the internal air passages).

Because a reamer is being pulled back through a bore, as opposed to being pushed like a drill bit, the reamer cuts and expands the walls of the bore by rotating cutting wheels. Also, the reamer may pull product via a product pulling feature. As the drill string is retracted, pressurized fluid is supplied from the drill string to the shaft of the reamer and up to the cutting wheels. The pressurized fluid provides a motive force for causing the cutting wheels to turn as the reamer is retracted.

The work of reaming a pilot bore is accomplished in the prior art via both pulling a relatively large reamer back through a relatively small pilot bore coupled with the cutting action of the cutting wheels. Notably, because the addition of a percussion force may improve the efficiency of a back reaming process, there is a need in the art for a reamer that is configured to work with a hammer component. More specifically, there is a need in the art for a reamer configured to promote the percussive cycle of a hammer component when the drill string is being retracted.

BRIEF SUMMARY

Various embodiments, aspects and features of the present invention provide solutions to various needs in the art by providing a hammer reamer that incorporates a percussion cycle when back reaming a pilot bore.

An exemplary hammer reamer according to the solution may comprise similar features to prior art reamers such as cutting wheels and a product-pulling feature. An exemplary hammer reamer, however, also includes a hammer component operable to deliver a percussive cycle of an internal piston component. Notably, an internal impact surface within the head of the hammer reamer is positioned relative to the piston component in the hammer consistent with a "sweet spot" position of a drill bit used in a pilot boring configuration. Unlike a slidably engaged drill bit, however, the internal impact surface in the hammer reamer is fixed in place so that the impact surface remains in the "sweet spot" of the piston stroke range. In this way, even though the hammer reamer is being pulled back through a bore while the drill string is being retracted, the hammer component may continue to deliver percussive blows to the hammer reamer head to introduce a vibratory force that contributes to the efficiency of the reaming process.

In an embodiment, a horizontal back reaming assembly configured to enlarge a pilot bore in a substrate may include a hammer assembly defining an axis and comprising a first end, second end, and a pneumatic hammer piston aligned along the axis and positioned between the first and second ends, a chuck bit removably mounted on the first end along the axis and configured to be hammered by the pneumatic hammer piston, and wherein a roller cone housing is detachably mounted on the chuck bit such that the assembly vibrates while back reaming the pilot bore.

In an embodiment, a method for back reaming a pilot bore includes operationally connecting the horizontal backreaming assembly to a drill string, supplying the assembly a pneumatic fluid sufficient to drive the pneumatic hammer piston, rotating the assembly, and urging the roller housing against a substrate defining the pilot bore.

DETAILED DESCRIPTION

Figure 1:
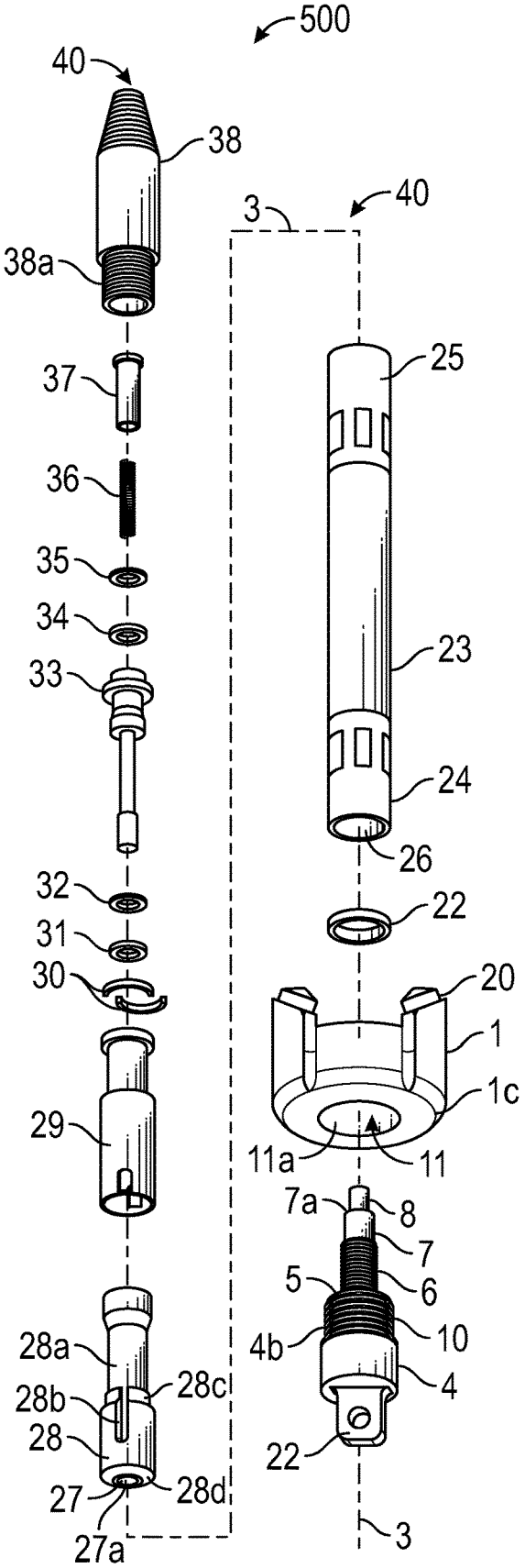
FIG. 1 is an exploded view of an air hammer assembly, a chuck bit, and a roller housing.
Figure 2:
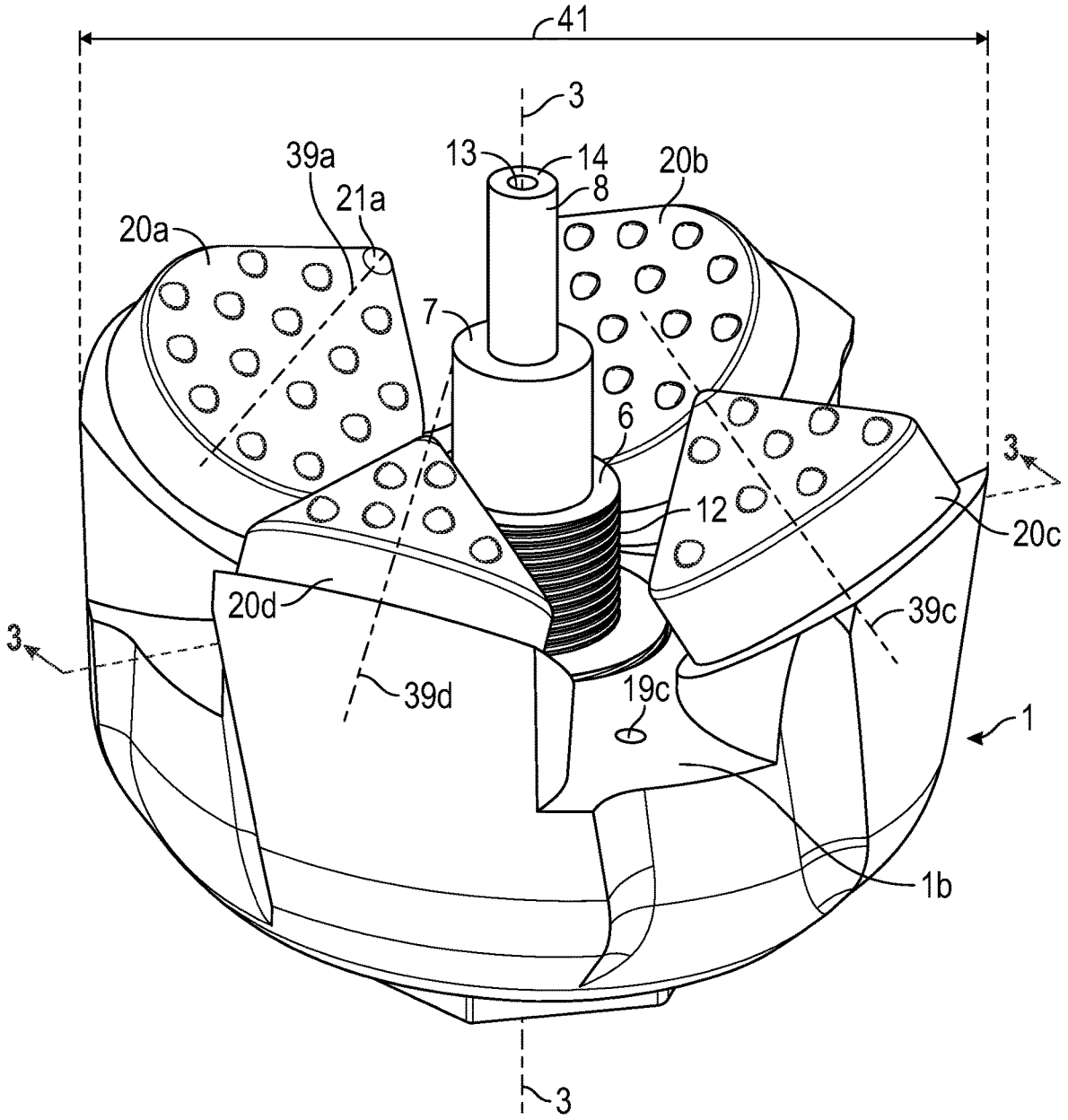
FIG. 2 is a perspective view of a chuck bit and roller housing.
Figure 3:
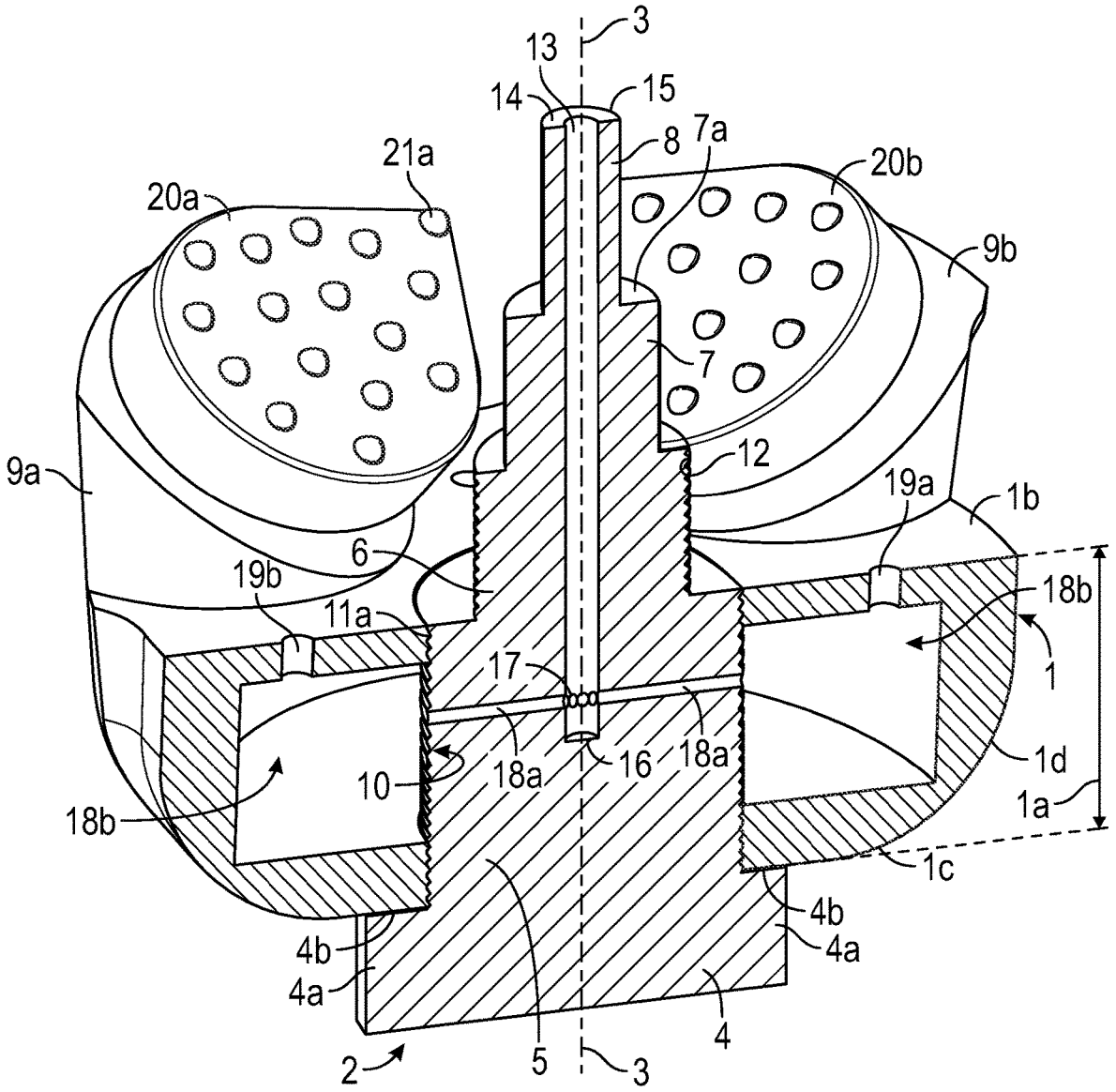
FIG. 3 is a cross sectional view of FIG. 2 along line 3.
Figure 4:
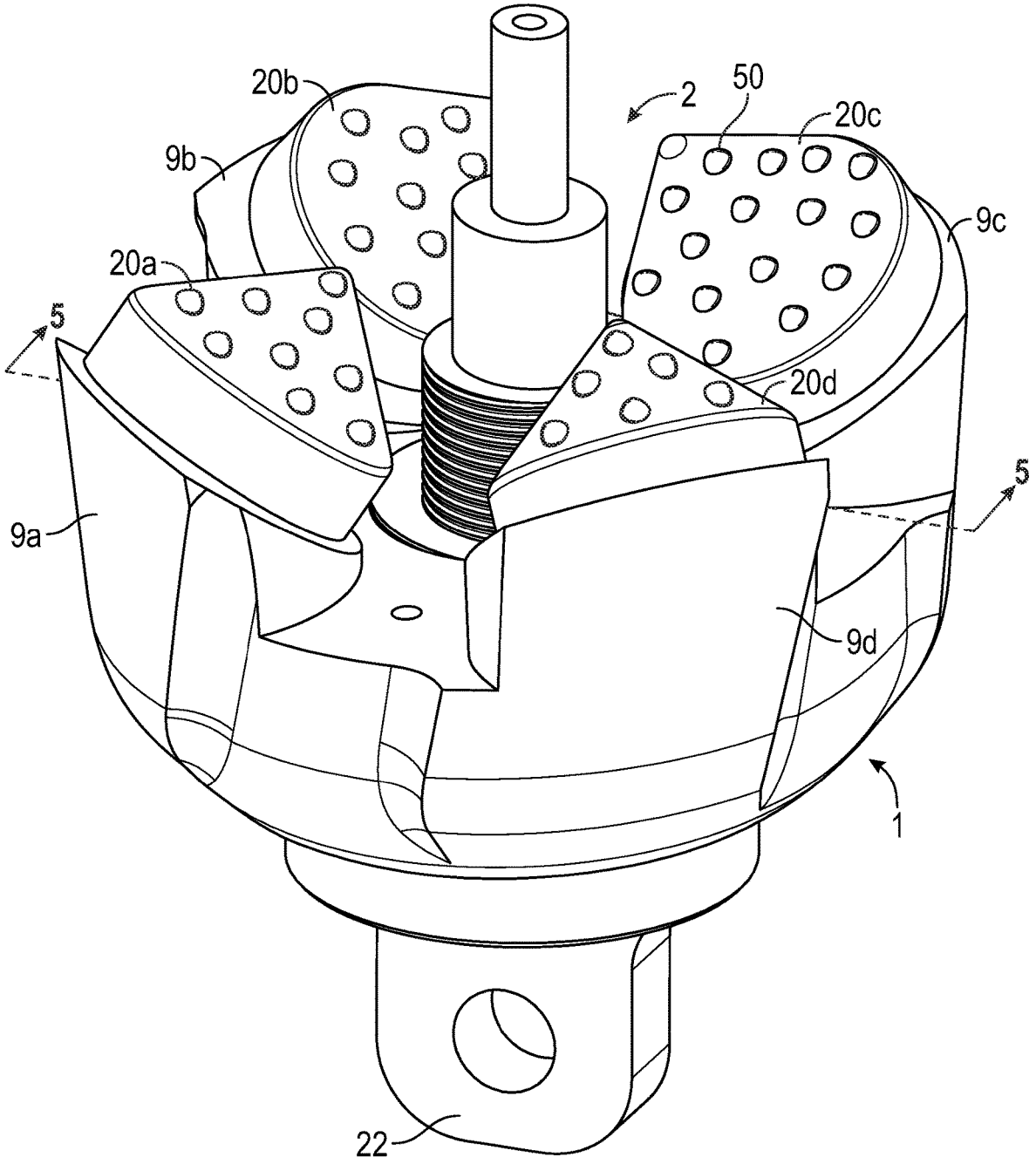
FIG. 4. is a second perspective view of a chuck bit and roller housing.

Embodiments and aspects of the present disclosure provide solutions to various needs in the art by providing a hammer reamer that incorporates a percussion cycle when back reaming a pilot bore.

A typical HDD drill assembly is screwed onto the bottom of the drill string and may include any number of components including, but not necessarily limited to, a sonde assembly, a bent sub, a hydraulic motor assembly (i.e., a hammer), a chuck bit and a drill bit.

The sonde assembly may include various instrumentation and transmitters for measuring various data such as angle of the string, rotation, direction of the bore, temperature and the like. The data measured by the sonde assembly is transmitted to the surface and used to adjust the drilling direction, as is understood by one of ordinary skill in the art. Location and guidance of the drilling is an important part of the drilling operation, as the drill bit is under the ground while drilling and, in most cases, not visible from the ground surface. Uncontrolled or unguided drilling can lead to substantial destruction, which can be eliminated by properly locating and guiding the drill bit.

The sonde assembly provides the means by which the drill bit may be located and guided through use of a "walk-over" locating system. The data collected by the sonde assembly is encoded into an electro-magnetic signal and transmitted through the ground to the surface to be received by a walk-over system. At the surface, when a walk-over system that includes a receiver (usually a hand-held locator) is positioned over the sonde, the signal is decoded and steering directions are subsequently relayed to a bore machine operator.

The bent sub portion of the HDD assembly, sometimes termed the adjustable kickoff sub, is a small segment of the drill string with a body portion that is bent at an angle rather than being straight. As one of ordinary skill in the art recognizes, the inclusion of a bent sub in the drill string makes it possible to steer the bore as needed by pushing off the side of the bore to produce a sideways force on the drill bit. The specific bend angle of a bent sub is application specific, as one of ordinary skill in the art understands. An exemplary bent sub, however, may include a lower thread portion that is inclined 1°-3° from the axis of the bent sub body.

The hydraulic motor, chuck and drill bit components of a HDD assembly work together to operate like a mini jackhammer that breaks hard rock into small flakes and dust. The debris of flakes and dust is subsequently blown clear of the drill bit by exhausted air. The percussion mechanism, i.e. the hydraulic motor, is located in the drill string directly behind the drill bit. The pipes that form the bulk of the drill string transmit the necessary feed force and rotation to the hydraulic motor and drill bit as well as the compressed air and/or drilling fluid. As understood by one of ordinary skill in the art, the drill pipes are added to the drill string successively behind the HDD assembly as the bore is drilled. A piston in the hydraulic motor strikes the impact surface of the drill bit directly, while the bent sub and hydraulic motor casing work together to provide straight and stable guidance of the drill bit. Advantageously, the impact energy generated in a HDD does not have to pass through the joints of the drill string and, as such, energy is not lost in the various joints.

Once the pilot bore is completed in an HDD process, the pilot bore may be back-reamed. In the back reaming step of a HDD process, the pilot bore may be expanded to a desired diameter and the walls of the bore conditioned for receipt of a product. Back reaming is a part of almost every horizontal directional drilling ("HDD") operation. Typically, to begin the back reaming step, the HDD assembly, or some portion of the HDD assembly, must be decoupled from the drill string so that a back reaming tool may be attached in its place. As described above, the back reaming tool may be pulled back through the pilot bore to enlarge the bore and condition its walls. In many HDD operations, the product to be installed may the product to be installed underground is pulled back through the bore during the back reaming step by attaching the product to a swivel which is mounted to the back reamer tool.

Current systems and methods for horizontal directional drilling are in need of improvement. Particularly, back reamers known in the art are not able to provide a vibratory force to assist the cutting wheels in the reaming process. Because the reamers known in the art are designed to be pulled back through a pilot bore, and because pulling the HDD string back through the pilot bore works to prevent the percussive cycle of a hammer, reamers are presently not able to take advantage of a percussive hammer cycle.

In an aspect of the present disclosure, and with reference to FIGS. 1-5, chuck bit 2 includes a base 4, first stage 5, second stage 6, third stage 7, and fourth stage 8 aligned along axis 3. Each successive stage 5-8 may be of successively narrower diameter and generally of cylindrical shape.

Roller housing 1, aligned along axis 3, comprises a washer region 1*a* and a plurality of conically shaped rollers, e.g., 20*a*-20*d*, rotationally mounted on spindles 9*a*-9*d*, respectively, and rotate about axes 39*a*, 39*b*, 39*c*, and 39*d*, which axes are skew to axis 3. Spindles 9*a*-9*d* may be removably mounted on, or integral with, upper face 1*b* of the washer region 1*a*.

Lower face 1*c* extends from upper face 1*b* and may define a curvilinear surface 1*d*. In another embodiment, curvilinear surface 1*d* may define a wall extending from upper face 1*b* and which wall may be substantially parallel to axis 3. Washer region 1*a* defines void 11 and substantially cylindrical wall 11*a*.

First stage 5 of chuck bit 2 may be shaped as a cylindrical body comprising a continuous threaded wall 10. Threaded wall 10 engages cylindrical threaded wall 11 of roller body 1. Second stage 6 may be shaped as a cylindrical body with threaded wall 12 which wall is configured to engage an air hammer aligned on axis 3. Stages 7 and 8 may be shaped as cylindrical bodies configured to engage an air hammer.

Chuck bit 2 may define a substantially cylindrical space 13 from opening 14 on top face 15 to wall 16. Space 13 is in fluid communication with channel 18*a* through opening 17. Opening 17 may comprise one or more openings to channels 18*a*. In this way, the one or more channels 18*a* are in fluid communication with void 18*b* defined by roller housing 1. Channels 19*a* and 19*b* are in fluid communication with void 18*b* and the outside of roller housing 1. Thus, space 13, channels 18*a*, 18*b*, and 19 form a path for a drilling fluid, e.g., air, to enter the chuck bit at opening 14 and be expelled outside roller housing 1.

In an embodiment, one or more channels 18*a* may be configured to enter an internal void defined by conical roller 20. At the apex 21 of conical roller 20 there may be one or more openings (not shown) to allow egress of a drilling fluid, e.g, air, to exit outside of roller housing 1.

Base 4 may comprise annular section 4*a* with upper wall 4*b*. Upper wall 4*b* engages roller housing wall 1*c* such that as chuck bit 2 is pulled through a pilot bore and a substrate, e.g., a rock substrate, roller cone housing 1 is urged through the substrate and roller cones 20*a*, 20*b*, 20*c*, and 20*d* may turn and grind the substrate, enlarging the bore. Any drilling fluid expelled from the assembly 100 may be recovered and/or left behind.

In another embodiment, base 4 may comprise an optionally detachable pulling eye 22. Pulling eye 22 may be used to pull, e.g., a line or an installable conduit or string through a channel pull-reamed by a pull-reaming assembly comprising chuck bit 2 and roller housing 1.

With reference to FIG. 1, assembly 500 is assembled along axis 3. Assembly 500 includes chuck bit 2 and threaded surface 10 that engages complementarily threaded surface 11 until housing 1 engages upper wall 4*b*. Stage 8 of chuck bit 2 passes through piston retaining ring 22 and into wear sleeve 23 wherein stage 8 engages wall 27*a* of piston 28. Stage 6 threadably engages a complementarily inner surface 26 of wear sleeve 23. Piston 28 face 7*a* of chuck bit 2 is in register with and engages opening 27 on a forward piston stroke. Inner cylinder 29 engages the upper end 27*a* such that inner cylinder 29 and piston 28 combine, with sufficient air or fluid pressure, to create a continuous percussion against stage 7, e.g., face 7*a*, thus vibrating the mechanism. As known to those of skill in the art, parts 22-38 are combined to operably secure piston 28 and inner cylinder 29 inside of wear sleeve 23. Housing backhead 28 may be attached to a drill or reaming string in order to pull the assembly 500 through a pilot bore and thus back-ream-widen the bore.

In an embodiment, assembly 500 may be assembled such that chuck bit 2 is inserted into end 24 and made ready for use. Roller housing 1 may be independently installed on chuck bit 2 so long as void 11 is larger than an external diameter of wear sleeve 23. In an embodiment, the diameter of stage 6 of chuck bit 2 is larger than an external diameter of wear sleeve 23.

Figure 5:
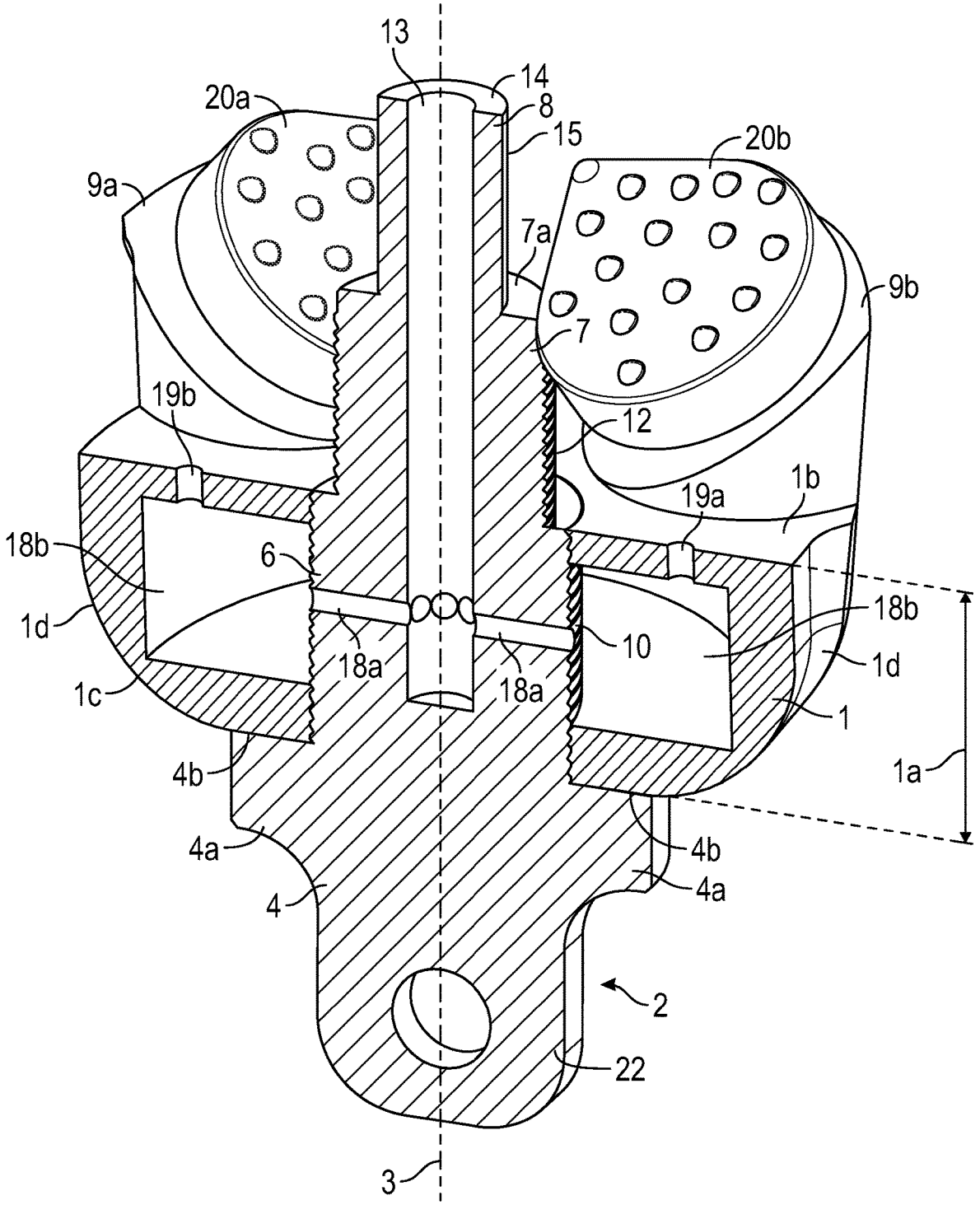
FIG. 5 is a cross sectional view of FIG. 4 along line 5.
Figure 6:
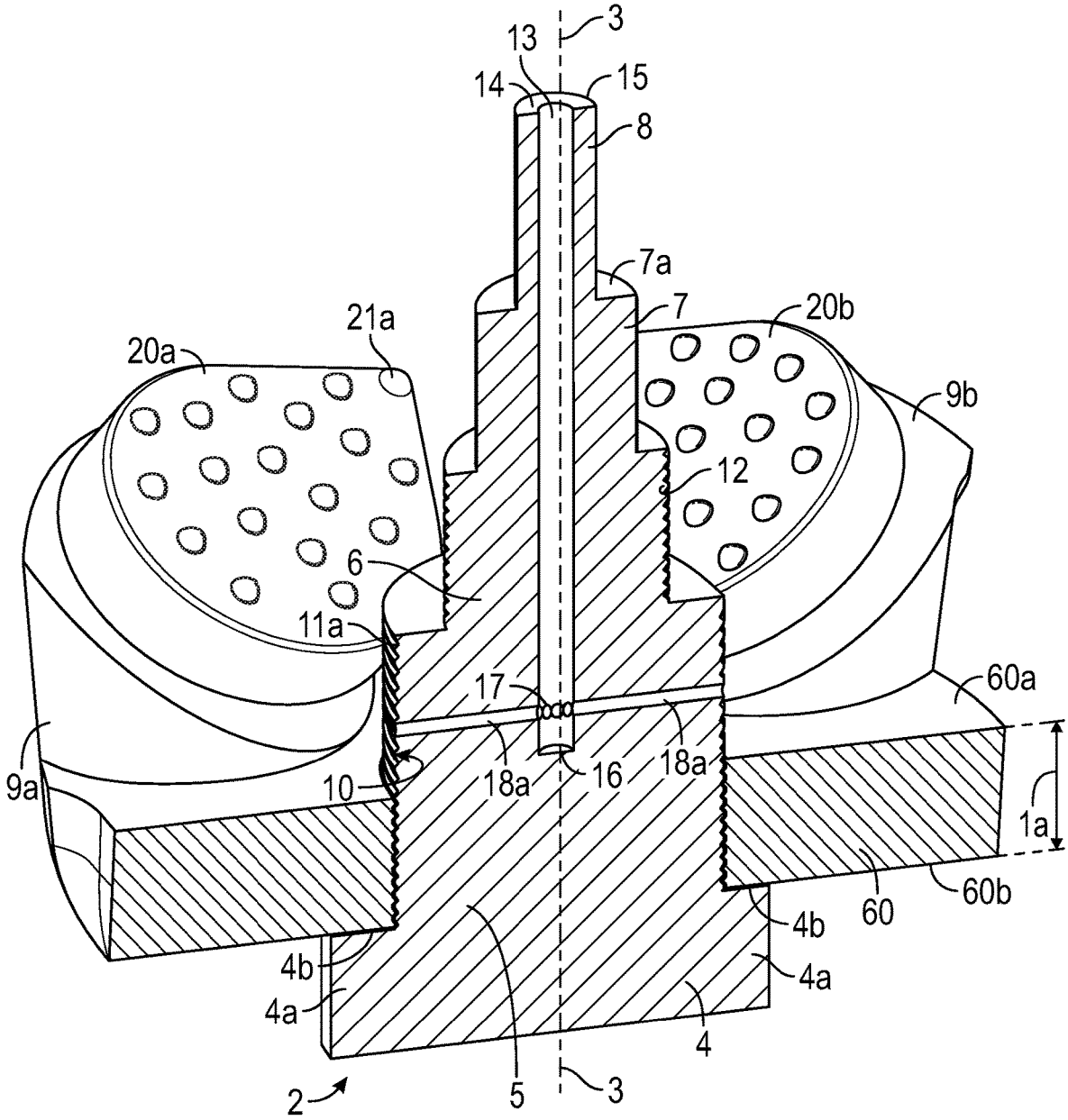
FIG. 6 is a cross sectional view of a second embodiment of the chuck bit and roller housing.

To best understand the nature of a back reamer according to an embodiment of the solution, an understanding of the basic percussive cycle of a hammer assembly. FIG. 5 illustrates the parts used in a percussive cycle delivered by a piston 28 to the impact surface 7*a* of chuck bit 2.

In an embodiment, a pressurized fluid, e.g., air, or a drilling fluid, 40 is directed along axis 3 through backhead housing 38 and check valve 37 toward air/fluid distributer 35. As understood by one of skill in the art, the pressurized fluid 40 is distributed the fluid 40 passes along an outer surface 28*a* of the inner cylinder 29 in the hammer component and toward chuck bit 2.

Fluid 40 continues along outer surface 28 and applies a force to an upper ledge 28*c* and one or more cut out areas 28*b* defined by piston 28, thereby urging piston 28 toward surface 7*a* of chuck bit 2.

After the downward piston stroke, fluid 40 engages lower ledge 28*d* of piston 28 and urges piston 28 toward inner cylinder 29. As opening 27 moves away from stage 7 and along the surface of stage 8, fluid 40 rushes between the outer surface of stage 8 and surface 27*a*, then through space 13 along axis 3 and continues through voids 18*a*, 18*b*, and 19*b*.

In this manner, by many cycles per minute, rapid repeated movement of piston 28 against stage 6 creates a strong percussive vibration that moves the entire assembly in a shaking movement.

In this manner, as the assembly 500 is turned and pulled to engage the side(s) of a pilot bore, the efficiency of the reamer is unexpectedly increased. For example, a 10 inch-diameter 41 may be turned at normal rotations against a solid granite substrate and advancement of from 6 inches to 12 inches per minute may be realized. Thus the vibrational component of a back reamer achieves unexpected efficiencies of back-reaming.

As the assembly 500 is pulled to engage a substrate, the assembly is generally turned such that roller housing 1 is rotabably tightened against chuck bit 2. Chuck bit 2 is in turn tightened against threadably engaged surface 26 of wear sleeve 23.

Systems, devices and methods of the various disclosures have been described using descriptions of embodiments thereof that are provided by way of example and are not intended to limit the scope of the disclosure. The described embodiments comprise different features, not all of which are required in all embodiments. Some embodiments utilize only some of the features or possible combinations of the features. Variations of embodiments that are described and embodiments that comprise different combinations of features noted in the described embodiments will occur to persons of the art.

Moreover, it will be appreciated by persons skilled in the art that systems, devices and methods of the disclosures are not limited by what has been particularly shown and described herein and above. Therefore, although selected aspects have been illustrated and described in detail, it will be understood that various substitutions and alterations may be made therein without departing from the spirit and scope of the present disclosure. As such, the scope of the disclosure is limited only as it may be defined by a claim.

TABLE 1

| Part Number | Description |
|---|---|
| 38 | Housing Backhead |
| 37 | Check Valve |
| 36 | Check Valve Spring |
| 35 | Steel Makeup Ring |
| 34 | Lock Ring |
| 33 | Air and/or Drilling Fluid Distributor |
| 32 | O-Ring |
| 31 | O-Ring |
| 30 | Seating Ring |
| 29 | Inner Cylinder |
| 28 | Piston |
| 23 | Wear Sleeve |
| 22 | Piston Retaining Ring |
| 1 | Roller Housing |
| 2 | Chuck bit |

What is claimed is:

1. A horizontal back reaming assembly configured to enlarge a pilot bore in a substrate, the assembly comprising:

a hammer assembly comprising a pneumatic hammer piston, wherein the pneumatic hammer piston is configured to percussively cycle within the hammer assembly when exposed to a pneumatic motive force such that the pneumatic hammer piston translates back and forth between a forward stroke position and a rear stroke position;

a back reaming tool configured to expand the pilot bore as the horizontal back reaming assembly is retracted through the pilot bore; and a chuck bit comprising an impact surface, wherein the chuck bit mechanically engages the hammer assembly to the back reaming tool such that the impact surface of the chuck bit is positioned to be struck by the pneumatic hammer piston when the pneumatic hammer piston percussively cycles;

wherein, when the horizontal back reaming assembly is retracted through the pilot bore, the hammer assembly and the chuck bit precede the back reaming tool; and wherein, when the pneumatic hammer piston strikes the impact surface of the chuck bit, the horizontal back reaming assembly vibrates.

2. The horizontal back reaming assembly of claim 1, wherein the chuck bit further comprises a channel configured to receive a pneumatic fluid.

3. The horizontal back reaming assembly of claim 1, wherein the back reaming tool is configured to receive a pneumatic fluid into an internal channel and expel the pneumatic fluid as the horizontal back reaming assembly is retracted through the pilot bore.

4. The horizontal back reaming assembly of claim 1, wherein the back reaming tool comprises a plurality of roller cones.

5. The horizontal back reaming assembly of claim 4, wherein the horizontal back reaming assembly is configured to be rotated as it is retracted through the pilot bore.

6. A method for back reaming a pilot bore comprising operationally connecting the horizontal back reaming assembly of claim 1 to a drill string, supplying the hammer assembly a pressurized pneumatic fluid sufficient to generate a motive force operable to percussively cycle the pneumatic hammer piston, rotating the horizontal back reaming assembly, and urging the back reaming tool to engage a substrate defining the pilot bore such that the pilot bore is expanded.

7. A horizontal back reaming assembly configured to enlarge a pilot bore in a substrate, the assembly comprising:

a hammer assembly comprising a pneumatic hammer piston, wherein the pneumatic hammer piston is configured to percussively cycle within the hammer assembly when exposed to a pneumatic motive force such that the pneumatic hammer piston translates back and forth between a forward stroke position and a rear stroke position;

a back reaming tool configured to expand the pilot bore as the horizontal back reaming assembly is retracted through the pilot bore; and a chuck bit comprising an impact surface positioned to be struck by the pneumatic hammer piston when the pneumatic hammer piston percussively cycles;

wherein, when the horizontal back reaming assembly is retracted through the pilot bore, the hammer assembly and the chuck bit precede the back reaming tool; and wherein, when the pneumatic hammer piston strikes the impact surface of the chuck bit, the horizontal back reaming assembly vibrates.

8. The horizontal back reaming assembly of claim 7, wherein the chuck bit further comprises a channel configured to receive a pneumatic fluid.

9. The horizontal back reaming assembly of claim 7, wherein the back reaming tool is configured to receive a pneumatic fluid into an internal channel and expel the pneumatic fluid as the horizontal back reaming assembly is retracted through the pilot bore.

10. The horizontal back reaming assembly of claim 7, wherein the back reaming tool comprises a plurality of roller cones.

11. The horizontal back reaming assembly of claim 10, wherein the horizontal back reaming assembly is configured to be rotated as it is retracted through the pilot bore.

* * * * *